United States Patent [19]

Magnuson

[11] 4,353,285

[45] Oct. 12, 1982

[54] RECOIL FORCE CORRECTION FOR ELEVATION IN AUTOMATIC WEAPONS EMPLOYING SOFT RECOIL

[75] Inventor: Roland A. Magnuson, Seattle, Wash.

[73] Assignee: PACCAR Inc., Bellevue, Wash.

[21] Appl. No.: 97,556

[22] Filed: Nov. 26, 1979

[51] Int. Cl.[3] ..... F41F 19/02

[52] U.S. Cl. ..... 89/42 B; 89/43 A

[58] Field of Search ..... 89/42 B, 43 A

[56] References Cited

U.S. PATENT DOCUMENTS 4,088,059 5/1978 Hayner ..... 89/43 A

*Primary Examiner*—Stephen C. Bentley

*Attorney, Agent, or Firm*—Seed, Berry, Vernon & Baynham

[57] ABSTRACT

A throttling valve develops a pressure to bring recoiling parts of a weapon to rest with a constant force. Counter-recoil is provided from recuperator pressure. The throttling valve is biased with a force proportional to the sine of the gun elevational angle to compensate for the gravitational component inline with recoil. Counter recoil force is controlled by a valve that regulates the recuperator pressure available for counter-recoil by an amount that is proportional to the sine of the gun elevation angle.

1 Claim, 6 Drawing Figures

RECOIL FORCE CORRECTION FOR ELEVATION IN AUTOMATIC WEAPONS EMPLOYING SOFT RECOIL

BACKGROUND OF THE INVENTION

1. Field of the Invention

This invention pertains to automatic weapons employing soft recoil and particularly to recoil force control for compensating for the in line gravitational component of the weapon gun barrel during recoil and counter-recoil.

2. Description of the Prior Art

In absorbing the impulse from firing in most large weapons, the recoiling parts are brought to rest by hydraulic pressure usually with the use of cylinders and pistons or rams which are coupled to the barrel and push fluid through an orifice directly as the gun barrel is moving.

It is known to use a parabolic type valve so that the changing orifice area is proportional to the square root of the remaining distance in recoil. The pressure required to push oil through an orifice is proportional to the velocity of the oil squared. Similarly, the energy necessary to bring the gun barrel to rest is proportional to the velocity of the gun barrel squared. These two characteristics are thus employed in the parabolic valve to bring the gun barrel to rest in recoil with a constant force.

A difficulty with the recoil arresting system is that it does not compensate for the component of the weight or gravity force of the gun barrel and attached moving structure in the direction of recoil. Thus, this weight component or potential energy will be added to or subtracted from the kinetic energy of the recoiling parts depending on whether the gun is elevated or depressed.

Almost all large weapons after recoiling from firing are designed to be propelled forward by pressurized air or oil generally using an air-oil accumulator known as a recuperator. In soft recoil weapons the round is fired as the barrel is moving forward and the recoil caused by the round brings the forward motion of the barrel to rest and then pushes it back to its rearward position. The impulse of the round since it is fired as the gun barrel is still moving forward in counter-recoil is absorbed partially by bringing the forward motion of the gun barrel to rest and the rest goes to produce recoil energy moving the gun barrel rearwardly. The recoil force can be reduced significantly using the soft recoil approach. When the gun barrel is elevated, however, the pressure stored in the recuperator may not be sufficient to give the barrel sufficient forward velocity at the time the round is fired so that the recoil from the round will cause the gun to recoil too severely, developing an excessive reaction force. In the alternative, if the gun is pointed downward, the pressure in the recuperator will send the gun barrel forward at such a velocity that the recoil force will not be sufficient to drive the barrel all the way back to its rearward position. This condition has heretofore precluded use of the soft recoil principle in automatic weapons that must recoil a fixed distance to facilitate loading from stationary magazines. Thus, there is a need for compensating for the component of gravity or weight of the gun barrel in the recoil and counter-recoil direction caused by the elevational position of the gun barrel.

SUMMARY OF THE INVENTION

It is an object of this invention to provide a gravitational component correction to the hydraulic cushioning mechanism of a soft recoil weapon for correcting for gravity effects due to elevational changes of the gun barrel.

It is another object of this invention to provide apparatus for correcting the amount of recuperative pressure provided for counter-recoil force to compensate for gravitational components in the counter-recoil direction due to elevational changes in the gun barrel.

It is still another object of this invention to provide gun barrel elevational corrections to compensate for gravity effects in both the recoil and counter-recoil controls of a soft recoil weapon.

Basically, these objects are obtained by sensing the elevational angle of the gun barrel and providing a compensating force to the main throttling valve corresponding to the sine of the elevation or depression angles of the gun barrel to respectively control the pressure of the hydraulic fluid used for cushioning the recoil by increasing the resistance to flow for elevation and decreasing the resistance to flow for depression.

Similarly, on counter-recoil the force from the recuperator pressurized fluid is controlled by a pressure regulator valve to low pressure values for depression angles and high pressure values for elevational angles.

Preferably both the recoil and the counter-recoil gravitational component corrections are provided by a single lever mechanism coupled with the pivotal motion of the gun barrel. Since the weapon's recoiling weight is generally of the same order of magnitude as the recoil reaction, the gravity component inline with the recoil must be accounted for. In this invention it is done by biasing a pilot piston controlling the throttling valve with a force proportional to the sine of the gun angle. The counter-recoil force from the recuperator is controlled by a valve that reduces or increases the pressure relative to the pressure required at 0° elevation an amount proportional to the sine of the gun depression or elevation angle.

DETAILED DESCRIPTION OF THE PREFERRED EMBODIMENT

Figure 1:
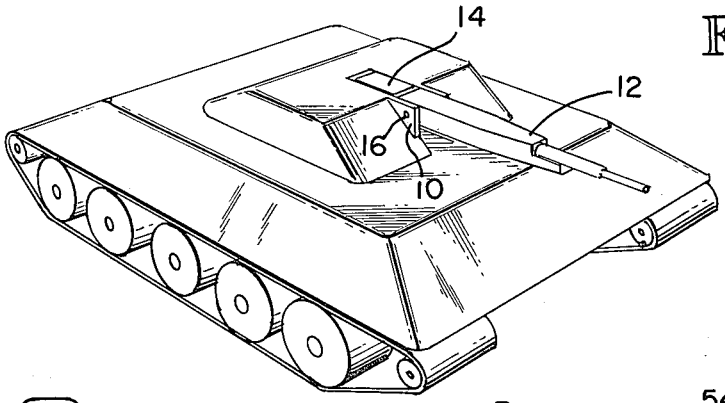
FIG. 1 is an overall schematic showing a soft recoil weapon embodying the principles of the invention.

As best shown in FIG. 1, a weapon 10 includes a barrel 12 which is slidably mounted in a carriage 14 that is mounted on a pivot 16. The angle of the gun barrel 12 can be either elevated above horizontal or depressed below horizontal.

Figure 2:
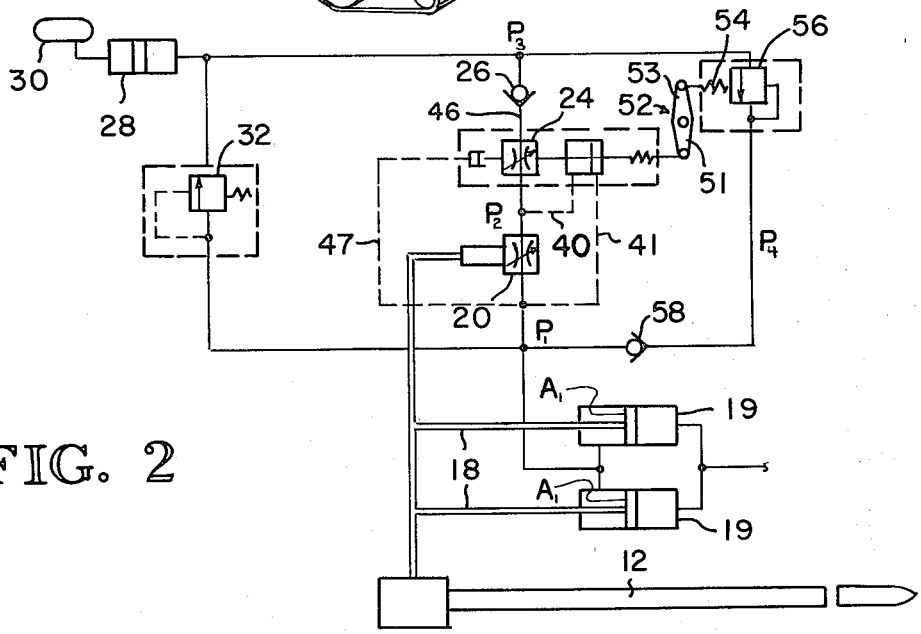
FIG. 2 is an operational schematic of the gravitational correction components in the invention.

The gun barrel will, of course, recoil due to the reaction force from the round that is fired from the gun barrel when it approaches or is at its forward position. It is thus necessary to cushion or bring the recoiling parts to rest in a controlled manner to avoid damage to the gun barrel, to assure that the gun barrel reaches a rearward loading station and to provide the proper forward velocity to maintain the automatic firing cycles. For this purpose and as shown in FIG. 2, the gun barrel 12 is rigidly linked to a pair of piston rods 18 coupled to pistons in cylinders 19. In the preferred embodiment the gun barrel is also rigidly linked to the stem of a variable orifice parabolic valve 20. This parabolic control valve is of a conventional type the size of whose orifice $a_o$ changes as a parabolic function in response to the remaining distance in recoil left to bring the gun barrel to a complete stop. The pressure drop across this parabolic valve 20 is called the signal pressure and at any instant is approximately 10 percent of the pressure required to bring the gun to a stop with a constant force in the remaining distance of recoil. Hydraulic pressure downstream of the parabolic valve enters a pilot operated throttling valve 24 which is shown in a preferred form in FIG. 3. The throttling valve restricts flow of the fluid from the cylinders 19 dependent upon the signal pressure to slow down the gun barrel if its velocity is too fast or to allow greater flow if the gun barrel is traveling too slow. It is important, of course, to assure that the gun barrel does not excessively recoil and damage the weapon as well as to see that it recoils sufficiently to reach the loading station. Fluid from the throttling valve 24 passes through a check valve 26 and thence to an air-oil recuperator 28. The recuperator is generally pressurized from air bottles 30 in a conventional manner. A conventional pressure relief valve 32 is provided to limit excessive pressure in the system caused by malfunction.

Figure 3:
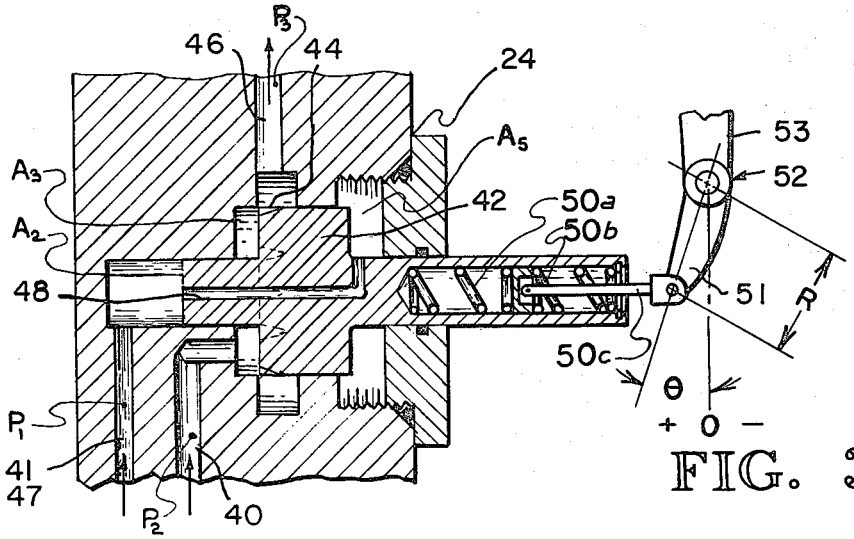
FIG. 3 is an enlarged view of a preferred throttling valve embodying the principles of the invention.

As best shown in FIG. 3, the throttling valve receives a $\Delta P$ differential ($P_1$–$P_2$) developed across parabolic valve 20 caused by oil flow from the movement of the combined areas $A_1$ of piston rods 18 to the left (the opposite ends of the cylinders are vented). This $\Delta P$ signal pressure is applied to equal areas $A_3$,$A_5$ on the left and right sides of spool 42 via lines 40 and 41 and passage 48. Notches 44 decrease the sensitivity of the spool in a conventional manner as the fluid passes the spool into port 46. The line 41 also applies pressure via line 47 to the far lefthand end of the spool which is of a cross-sectional area $A_2$ of approximately ten percent of the main spool cross-sectional area $A_3$ or $A_5$ acted on by the $\Delta P$ differential pressure. It should be understood, however, that the schematic valve shown in FIG. 2 could also be separate valves and valve cores as well as the integral valve shown in FIG. 3. Basically, in the throttling valve 24 the signal pressure in lines 40 and 41 is applied across the large cross-sectional area of the spool 42 and the upstream pressure from the parabolic valve is applied to the ten percent cross-sectional area ($A_2$) of the reduced size of the spool. The opposite side of the ten percent area is vented to atmosphere. These combined pressures to this valve as is conventional will throttle the flow from the cylinders 19 to control the recoil velocity of the gun barrel.

In accordance with this invention, there is added to the throttle valve 24 of FIG. 3 springs 50*a* and 50*b* that engage opposite sides of a sliding link 50*c*. Link 50*c* is connected to an arm 51. The arm 51 forms part of a linkage 52 that pivots in direct relation to pivotal movement of the gun barrel such as by being coupled to the pivot axis 16 of the weapon. The linkage also has an upper arm 53. The lower arm 51 is positioned to move clockwise as the gun barrel is elevated. This pushes on the spring 50*a* pushing the spool 42 to the left in FIG. 3 thus retarding flow from the cylinders. If the gun elevational angle is $\phi$, then the spring rate of each spring is equal to:

$$A_2W/2A_1R$$

where $A_2$ is the small cross-sectional area of the spool 42, $A_1$ is the net rod end piston areas of the recoil piston rods 18, W is the weight of the recoiling parts and R is the length of the lever arm 51. The forces of the two springs cancel at 0° elevation and the net force on the spool from the springs=

$$(A_2/A_1)W \sin \phi.$$

As is readily understood, therefore, the gravitational component in the direction of recoil which would add to the velocity of the gun barrel is compensated for by corresponding resistance to flow out of the cylinders. Likewise, the arm 51 moves counterclockwise in the direction of gun depression angles and the spool 42 will be allowed to move to the right in FIG. 3, thus increasing flow.

The arm 53 is connected to a spring 54 that is coupled to the spool of a pressure regulating valve 56. The pressure regulating valve directs flow from the recuperator through a check valve 58 directly to the cylinders 19 to provide counter recoil force to the gun barrel. As the arm 53 moves clockwise for elevational increases in the gun, the valve spool is moved to increase pressure from the recuperator. Similarly, when the arm 53 is moved counterclockwise for depressive angles of the gun barrel, the valve restricts flow to reduce the counter-recoil force on the gun barrel.

Figure 4:
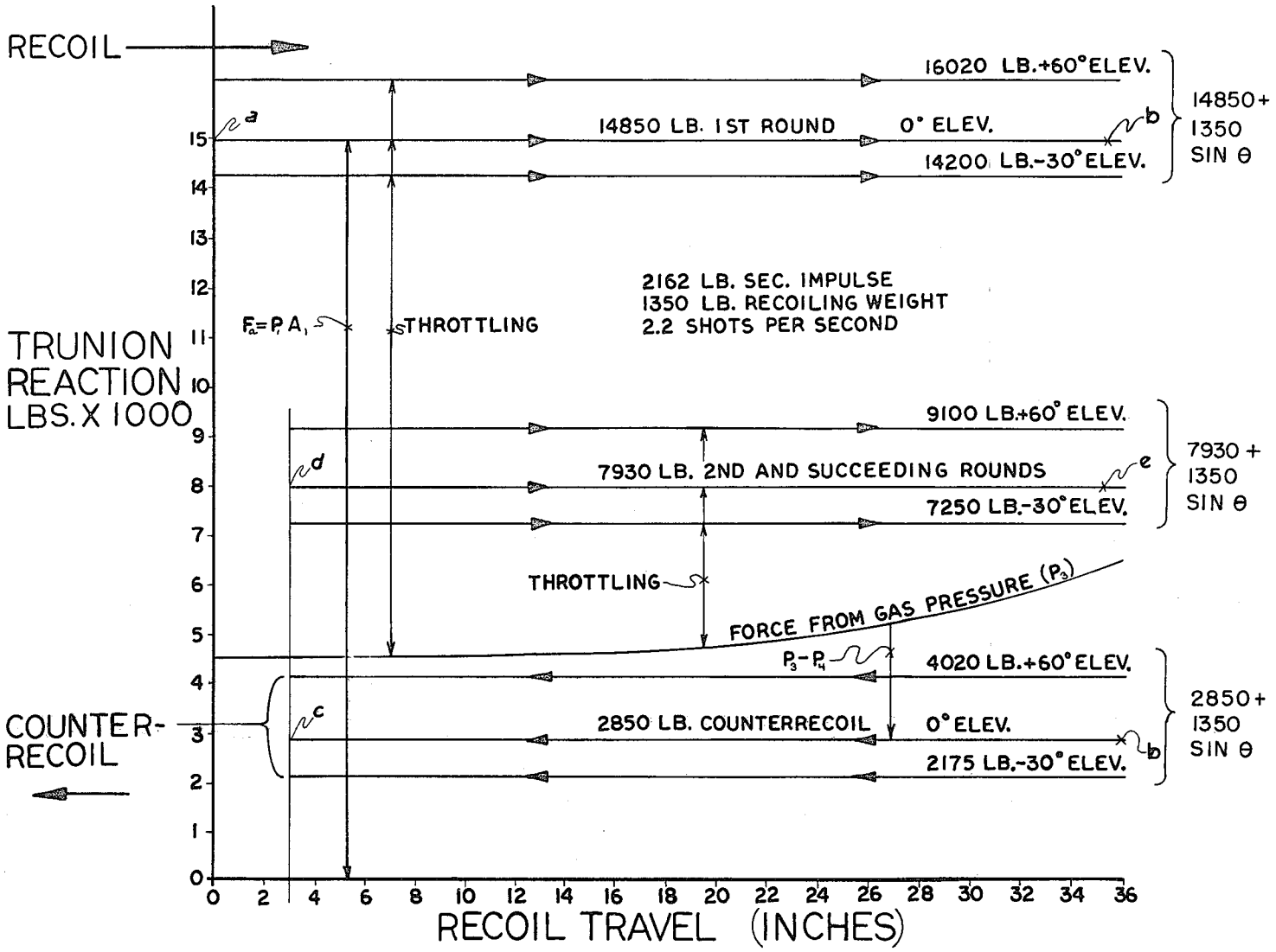
FIG. 4 is a graphical representation of typical recoil and counterrecoil cycles of a weapon embodying the principles of the invention.

A graphic illustration of the forces acting through a typical cycle of operation is shown in FIG. 4. Starting at point "a" with a round in battery waiting to fire at standstill and at 0° elevation, the round is fired causing the barrel to recoil against a force developed by the sum of the recuperator pressure and the throttling pressure necessary to bring the barrel to rest at point "b" shown as Fa. The barrel then reaches its rearward position and pressure $P_3$ starts the barrel forward in counter-recoil reaching point "c" with pressure $P_3$ being regulated by the pressure drop across valve 56 to prevent excessive velocities. At point c the round is fired in soft recoil and the force rises to point d initiating recoil again to point e. The cycle repeats itself now through path b, c, d, e until firing ceases. As also can be seen from FIG. 4, increases in elevation angle require greater throttling in recoil and less pressure drop across valve 56 in counter-recoil, whereas negative elevation angles require the opposite corrections.

Figure 5:
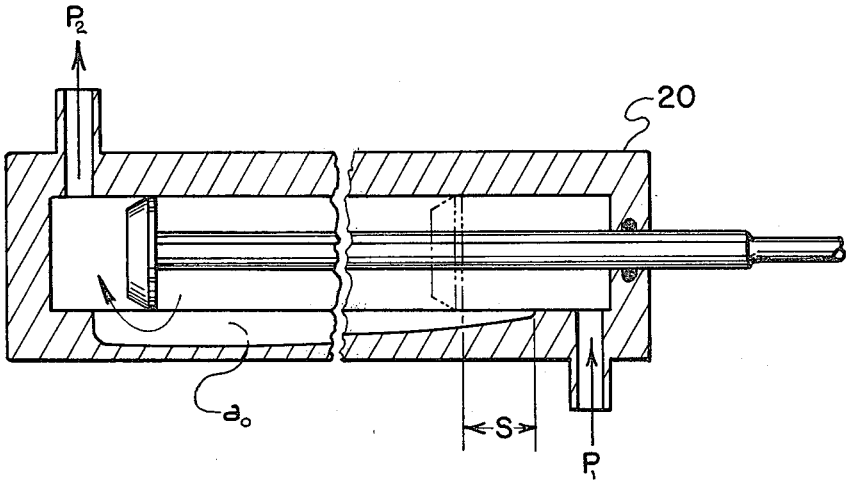
FIG. 5 is a typical conventional parabolic orifice valve.
Figure 6:
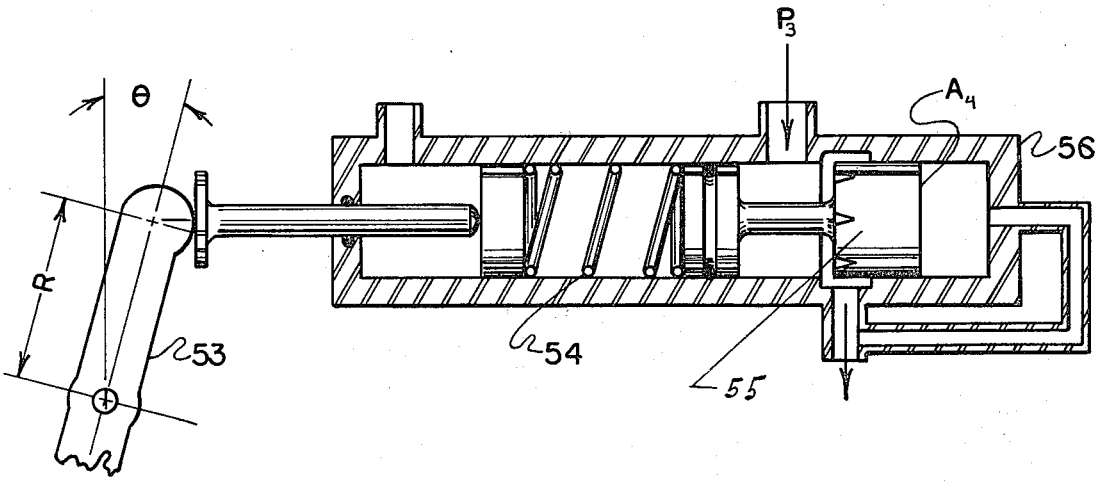
FIG. 6 is a preferred embodiment of a gun angle correction pressure regulator valve.

For purposes of completeness FIG. 5 illustrates a known variable parabolic orifice-type valve 20. The parabolic orifice A cross sectional area:

$$A_o = \frac{1}{K}\sqrt{\frac{A_3(A_1)^3 eS}{A_2 W}}$$

where:

$A_1$=combined area of piston rods 18 e=oil density lb/cu.in.

S=distance from end of recoil

K=orifice coefficient of 0.61 for sharp edge orifice

While the preferred embodiments of the invention have been illustrated and described, it should be understood that variations will be apparent to one skilled in the art without departing from the principles herein. Accordingly, the invention is not to be limited to the specific embodiments described in the drawings.

I claim:

1. Apparatus for providing a relatively constant recoil travel length for a soft recoil weapon of the type having a carriage pivotally mounted for varying elevational position, a gun barrel capable of recoiling and counter-recoiling in said carriage between a rearward loading station and a forward firing station, comprising:

fluid cushioning means having actuator means coupled to the gun barrel for movement therewith and moving fluid through a variable orifice in response to said movement for arresting the recoil movement of the gun barrel in a controlled manner, including variable throttling means for decreasing or increasing the resistance to flow from the actuator means in response to the amount of the pressure differential of the fluid across the variable orifice, pressure storing means for storing pressurized fluid from the cushioning means for providing counter-recoil pressure to said actuator means, means for sensing the elevational angle of the gun barrel, and gravity compensation means including first control means responsive to the angle sensing means for varying the throttling means to change the resistance to flow in response to elevation or depressing angle changes in the gun barrel for compensating the fluid cushioning means from gravity effects due to such angle changes, said gravity compensation means including second control means responsive to said angle sensing means for adjusting the fluid pressure from said recuperative pressurized fluid storing means to said actuator means for adjusting the counter-recoil force on the gun barrel to compensate for the gravity effects of such angle changes of the gun barrel, said variable orifice including a parabolic variable orifice flow control valve having a pressure differential during recoil equal to a predetermined constant percentage of the pressure necessary to bring the gun barrel to rest with a constant force in the remaining distance of recoil, said variable throttling means including a valve spool having first and second axially spaced opposed equal cross-sectional areas, a small, axially spaced, third cross-sectional area which is a predetermined percentage of each of the first and second areas and on the same side of the spool as said first area, and a spring-loaded stem for adjusting the force balance on the spool, said first control means including means for moving the stem in response to angle adjustments of the gun barrel, means for connecting the pressure differential from across the parabolic flow control valve to said first and second areas respectively with the higher pressure acting on the second area and means for connecting the pressure from upstream of the parabolic flow control valve also to said small third cross-sectional area whereby the constant pressure differential acting on the first and second areas plus the pressure acting on said third area attempts to keep said spool balanced while said stem moving means responsive to angle adjustments of the gun barrel overcomes said balance.

* * * * *